US011292150B2

(12) United States Patent
Ragnarsson

(10) Patent No.: US 11,292,150 B2
(45) Date of Patent: Apr. 5, 2022

(54) CHAIN FLAIL DEBARKING APPARATUS WITH MOVEABLE FLAIL ASSEMBLY

(71) Applicant: TIGERCAT INDUSTRIES INC., Brantford (CA)

(72) Inventor: Anders Ragnarsson, Chester, NH (US)

(73) Assignee: Tigercat Industries Inc., Brantford (CA)

( * ) Notice: Subject to any disclaimer, the term of this patent is extended or adjusted under 35 U.S.C. 154(b) by 55 days.

(21) Appl. No.: 16/856,520

(22) Filed: Apr. 23, 2020

(65) Prior Publication Data

US 2020/0338785 A1 Oct. 29, 2020

Related U.S. Application Data

(60) Provisional application No. 62/837,982, filed on Apr. 24, 2019.

(51) Int. Cl.

| | |
|---|---|
| ***B27L 1/02*** | (2006.01) |
| ***B27L 1/12*** | (2006.01) |
| ***B27L 11/02*** | (2006.01) |
| ***B27L 11/00*** | (2006.01) |

(52) U.S. Cl.

CPC ..... *B27L 1/122* (2013.01); *B27L 11/002* (2013.01); *B27L 11/02* (2013.01)

(58) Field of Classification Search

CPC .. B27L 1/12; B27L 1/122; B27L 1/127; B27L 11/02; B27L 11/04; B27L 11/06; B27L 11/002

See application file for complete search history.

(56) References Cited

U.S. PATENT DOCUMENTS

| | | | | |
|---|---|---|---|---|
| 4,719,950 | A * | 1/1988 | Peterson | B27L 1/122 144/208.7 |
| 5,148,844 | A * | 9/1992 | Robison | A01G 23/097 144/208.7 |
| 5,322,104 | A * | 6/1994 | Morey | B27L 1/122 144/208.7 |
| 5,349,999 | A * | 9/1994 | Peterson | A01G 23/097 144/208.7 |
| 9,738,008 | B2 * | 8/2017 | Peterson | B27L 1/122 |
| 10,052,788 | B2 * | 8/2018 | Windrim | B27L 1/122 |

(Continued)

*Primary Examiner* — Matthew Katcoff

(74) *Attorney, Agent, or Firm* — Finch & Maloney, PLLC; Michael Bujold; Jay Franklin

(57) ABSTRACT

A chain flail debarking apparatus including a flail chamber accommodating at least first and second rotatable flail shafts being supported on a movable flail assembly framework, and both of the first and second rotatable flail shafts having a plurality of chains, a disc chipper for receiving the debarked logs and trees from the flail chamber and generating wood chips having a desired shape and size, and a single drive for driving both the disc chipper and at least the first and second rotatable flail shafts in the flail chamber. A pivotable feed roller is located adjacent an inlet to the flail chamber for sensing a diameter of the logs and trees to be debarked and moving the movable flail assembly framework, relative to the base frame, so as to maintain the logs and trees being debarked in the flail chamber, substantially centered with respect to both the first and second rotatable flail shafts so that both upwardly and downwardly facing surfaces of the logs and trees being debarked are substantially equally treated.

19 Claims, 9 Drawing Sheets

(56) References Cited

U.S. PATENT DOCUMENTS

| | | | | |
|---|---|---|---|---|
| 2005/0034784 | A1* | 2/2005 | Tapscott | B27L 1/122<br>144/338 |
| 2017/0305032 | A1* | 10/2017 | Ragnarsson | B27L 11/02 |

* cited by examiner

CHAIN FLAIL DEBARKING APPARATUS WITH MOVEABLE FLAIL ASSEMBLY

FIELD

The present disclosure relates to a portable chain flail debarking apparatus which has a movable flail assembly. In particular, the flail assembly is movable in a vertical direction, during operation, which assists with maintaining the log(s) and/or tree(s) being processed substantially centered with respect to the chains or chain flails of the flail assembly so that both the upwardly and downwardly facing surfaces of the log(s) and/or tree(s) being processed will be substantially equally treated.

BACKGROUND

Chain and chain flails have been used for many years in forestry equipment for removing bark from tree logs and/or tree trunks. Such systems have been particularly useful in removing bark and limbs from logs or trunks that are subsequently cut into chips for use in the making of wood pulp products.

Wood chip manufacturers are particularly conscious of the need to remove as much bark as possible so as to minimize the amount of bark which is contained in the pulp chips in order to obtain the highest price possible from the wood pulp manufacturer. If a load of wood chips contains too high a percentage of bark within the wood chips, then the wood pulp manufacturer pays a considerably lower price for such wood chips.

A conventional chain flail debarking apparatus typically has two or more flail assemblies which are located within a flail chamber through which the log(s) or trunk(s) will pass. Each of the fail assemblies supports a plurality of chains or chain flails for engaging, pounding and/or abrading against the exterior surface of the log(s) or trunk(s) to cut, dislodge and/or remove substantially all of the limbs and as much bark as possible as the log(s) or trunk(s) passes through the flail chamber.

Moreover, conventional chain flail debarking apparatuses typically have a drive associated with each one of the flail assemblies, which can lead to a complicated and expensive drive system for the flail assemblies.

SUMMARY

An object of the present disclosure is to provide an improved portable chain flail debarking apparatus that overcomes at least one issue associated with conventional systems.

Generally speaking, the embodiments herein are intended to reliably remove bark, limbs, leaves, branches and/or other debris, from log(s) and/or tree(s) being processed, while still being readily transportable from one job site to another job site. In at least some embodiments, the chain flail debarking apparatus utilizes a common drive which drives the disc chipper and all of the flail assemblies. This arrangement allows the apparatus to be more portable and also simplifies the design of the apparatus by minimizing the components of the hydraulic system, which lowers the overall cost of the chain flail debarking apparatus.

In some embodiments, the apparatus provides for the flail assemblies and flail drive input to be supported by a movable framework so that, as a log(s) and/or tree(s) passes through the flail chamber, the framework adjusts so that the log(s) and/or tree(s) remains centered between the upper and the lower flail assemblies so that both the upwardly and the downwardly facing surfaces of the log(s) and/or tree(s) being processed are substantially equally treated.

In some embodiments, a disc chipper is mounted on the base frame at a 38 degree angle with respect to a longitudinal axis of the chain flail debarking apparatus, i.e., the rotational plane defined by the rotating chipping disc forms a 38 degree angle with the longitudinal axis of the chain flail debarking apparatus, and the apparatus utilizes a single motor or engine to drive both the rotatable chipping disc of the disc chipper as well as the flail assemblies which debark the log(s) and/or tree(s) being processed. In other embodiments, the disc chipper is driven by a first drive and the flail assembly/ies is driven by a second drive.

Still another object of the present disclosure is avoid power losses, which typically occur with hydraulic drives, and also minimize wear to the rotating horizontal flail shafts during operation of the chain flail debarking apparatus.

The present disclosure also relates to a chain flail debarking apparatus for removing limbs and bark from a log or a tree to be treated, the chain flail debarking apparatus comprising: a base frame supporting a flail chamber and at least one transfer roller to facilitate feeding of the log or tree into the flail chamber; a flail assembly framework being supported by the base frame within the flail chamber, and the flail assembly framework being vertically movable relative to the base frame by at least one displacement member; at least a first flail assembly comprising first and second rotatable flail shafts, the first and the second rotatable flail shafts being supported by the flail assembly framework so as to move along with the flail assembly framework, and each of the first and second rotatable flail shafts supporting a plurality of chains; and a movable guide being located adjacent an inlet of the flail chamber for determining a diameter of the log or tree entering into the flail chamber and activating the at least one displacement member so as to adjust a position of the flail assembly framework, relative to the base frame, and maintain the log or tree, entering into the flail chamber, substantially centered between at least the first and second rotatable flail shafts so that the log or tree, entering into the flail chamber, is substantially uniformly debarked.

The invention also relates to a method of forming a chain flail debarking apparatus for removing limbs and bark from a log or a tree to be treated, the method comprising: supporting, on a base frame, a flail chamber and at least one transfer roller, to facilitate feeding of the log or tree into the flail chamber; supporting a flail assembly framework on the base frame and within the flail chamber, and positioning at least one displacement member for moving the flail assembly framework relative to the base frame; forming at least a first flail assembly from first and second rotatable flail shafts, the first and the second rotatable flail shafts being supported by the flail assembly framework so as to move along with the flail assembly framework, and each of the first and second rotatable flail shafts supporting a plurality of chains; and locating a movable guide adjacent an inlet of the flail chamber for determining a diameter of the log or tree entering into the flail chamber and activating the at least one displacement member so as to adjust a position of the flail assembly framework, relative to the base frame, and maintain the log or tree, entering into the flail chamber, substantially centered between at least the first and second rotatable flail shafts so that the log or tree, entering into the flail chamber, is substantially uniformly debarked.

BRIEF DESCRIPTION OF THE DRAWINGS

The accompanying drawings, which are incorporated in and constitute a part of the specification, illustrate various embodiments and, together with the general description given above and the detailed description given below, serve to explain the principles herein. It is to be appreciated that the accompanying drawings are not necessarily to scale. The accompanying drawings include.

DETAILED DESCRIPTION

The following detailed description should be read in conjunction with the appended drawings. It is to be appreciated that the following detailed description of various embodiments is by way of example only and is not meant to limit.

Generally speaking, the embodiments relate to a chain flail debarking apparatus which includes a common drive, for all of the flail assemblies, and a movable flail assembly framework. This arrangement assists with portability/maintenance as well as with maintaining the log(s) and/or tree(s) being processed substantially centered with respect to the chains of each flail assembly so that both the upwardly and downwardly facing surfaces of the log(s) and/or tree(s) being processed will be substantially equally treated so as to remove as much bark as possible therefrom.

Figure 1:
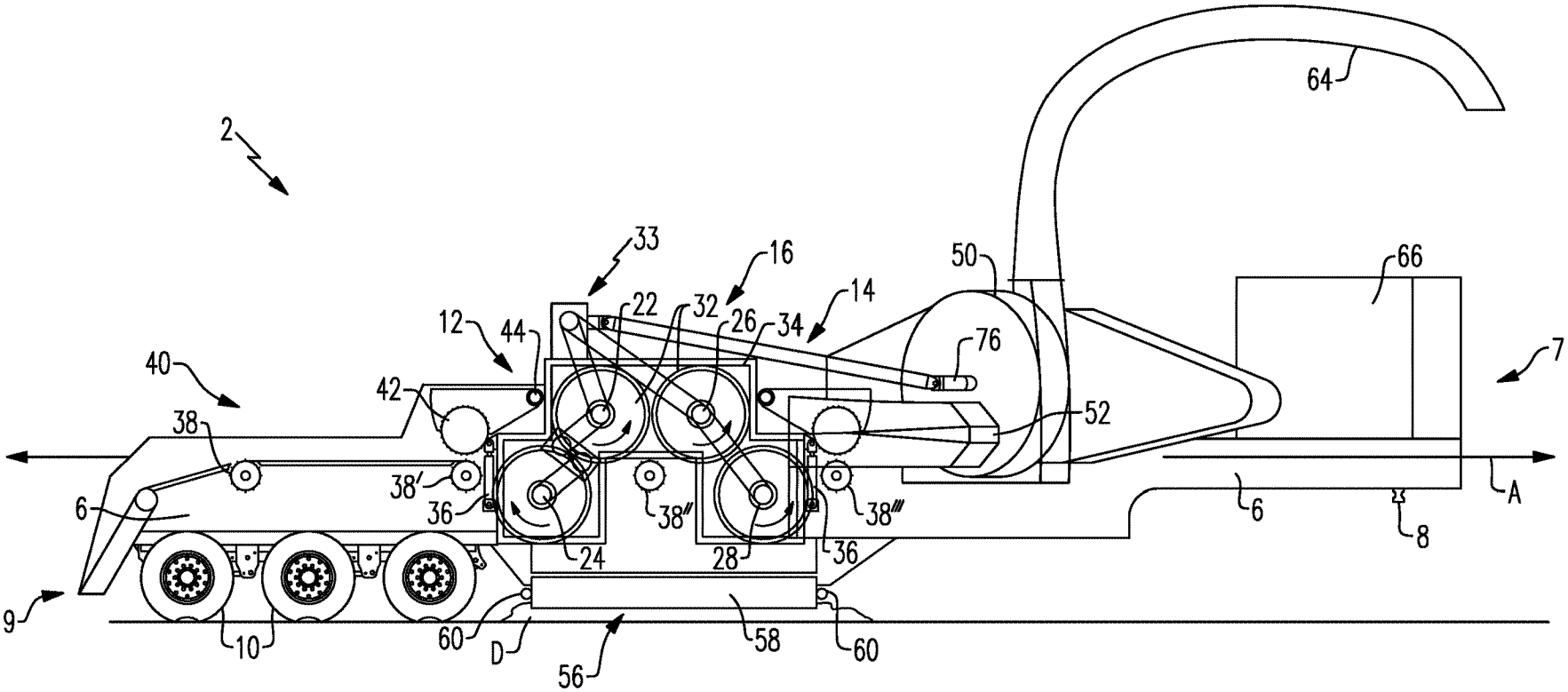
FIG. 1 is a diagrammatic side elevation view of an embodiment of a chain flail debarking apparatus.
Figure 1A:
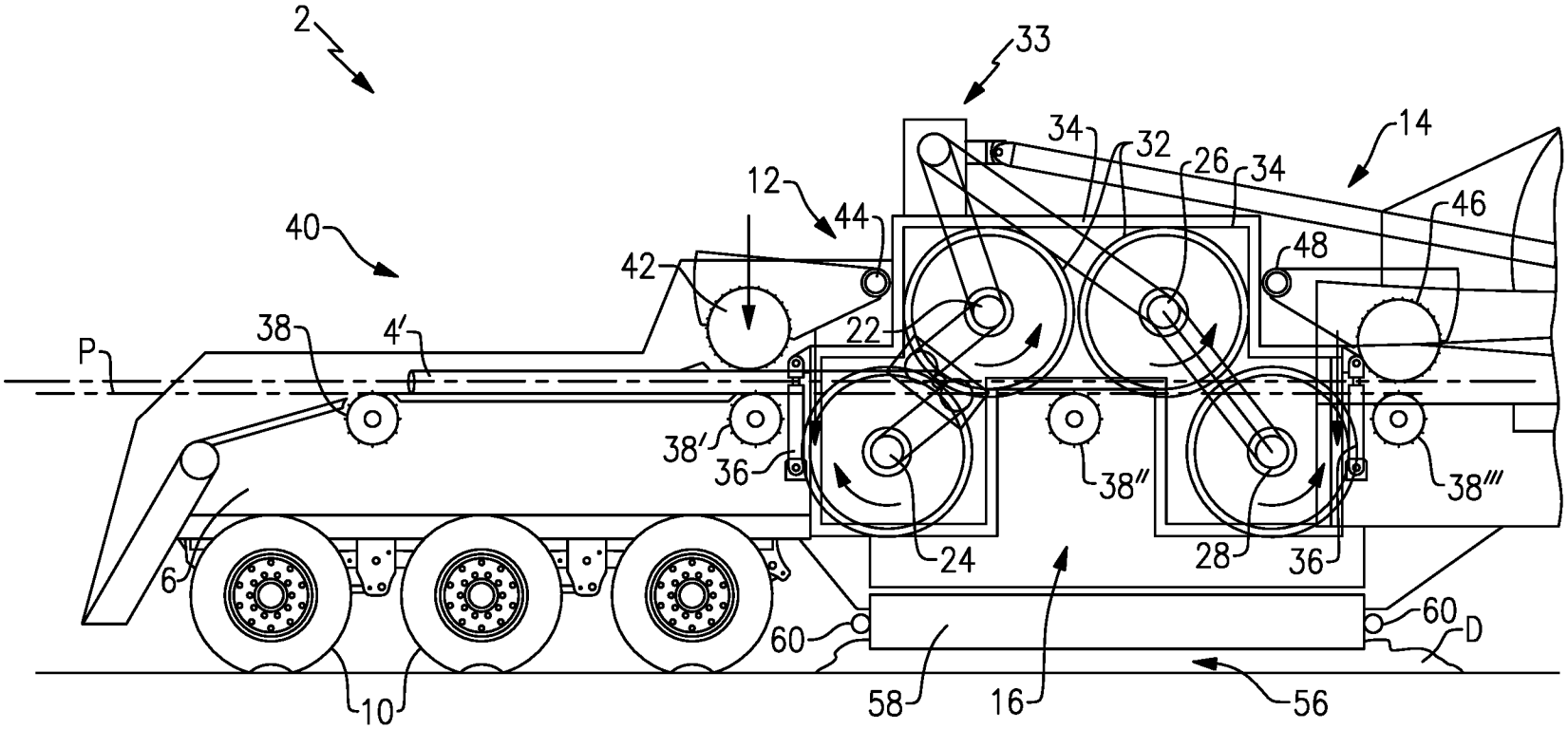
FIG. 1A is a diagrammatic side elevation view of the chain flail debarking apparatus of FIG. 1 showing upward adjustment of the flail assembly framework to accommodate a smaller diameter log.
Figure 1B:
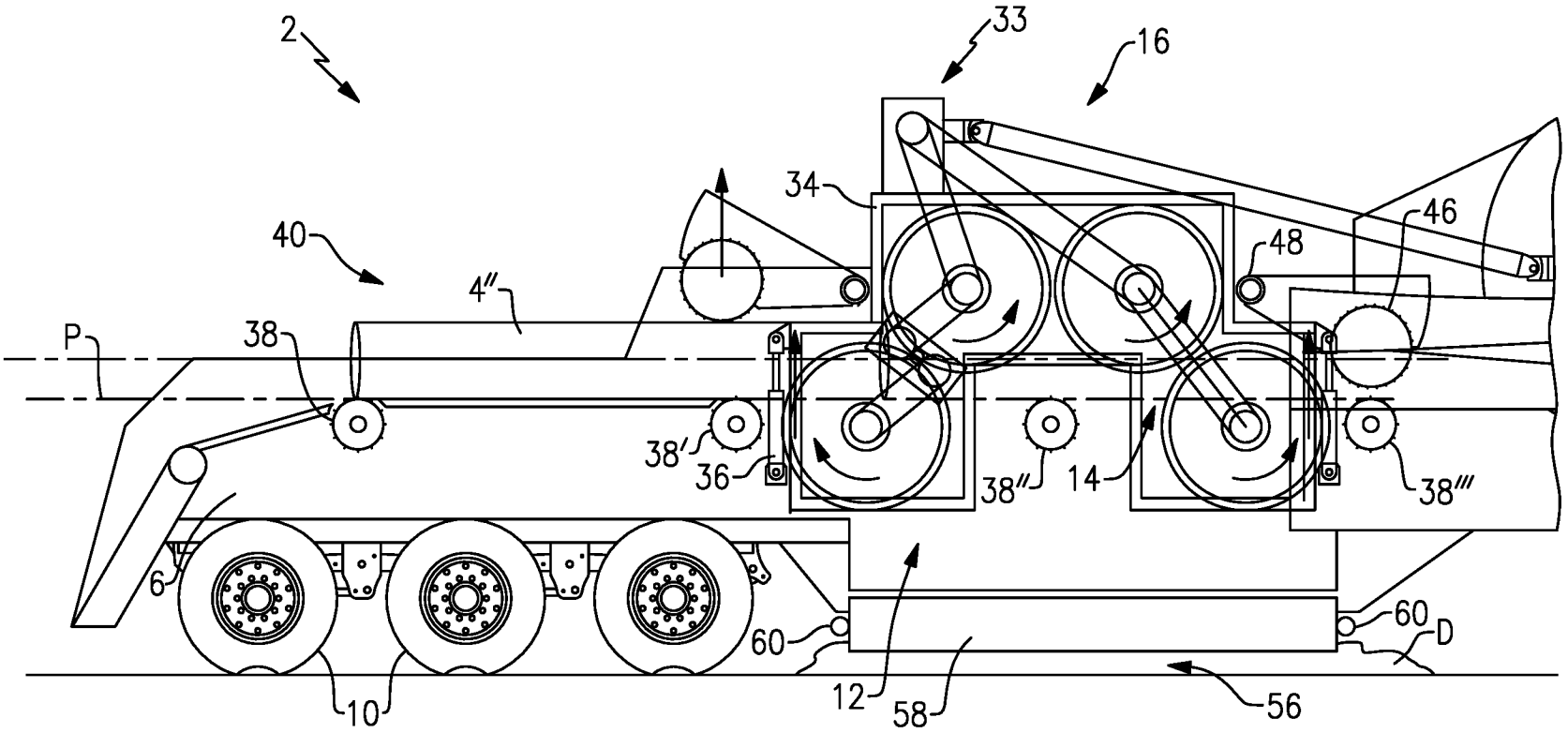
FIG. 1B is a diagrammatic side elevation view of the chain flail debarking apparatus of FIG. 1 showing increased upward adjustment of the flail assembly framework to accommodate a larger diameter log.
Figure 2:
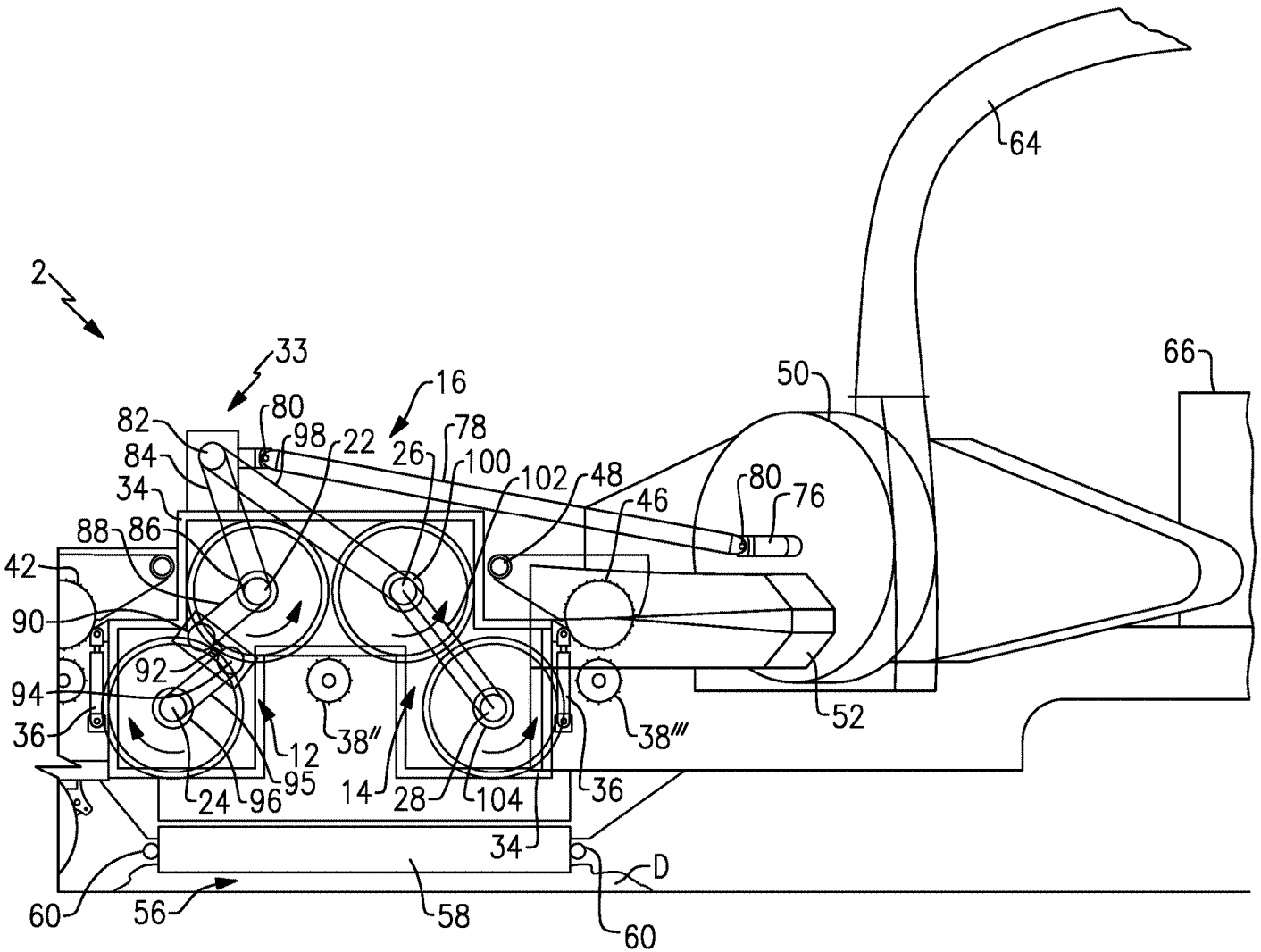
FIG. 2 is a diagrammatic side elevation view of the chain flail debarking apparatus of FIG. 1, showing details of a disc shaft through drive for driving the flail assemblies.
Figure 3:
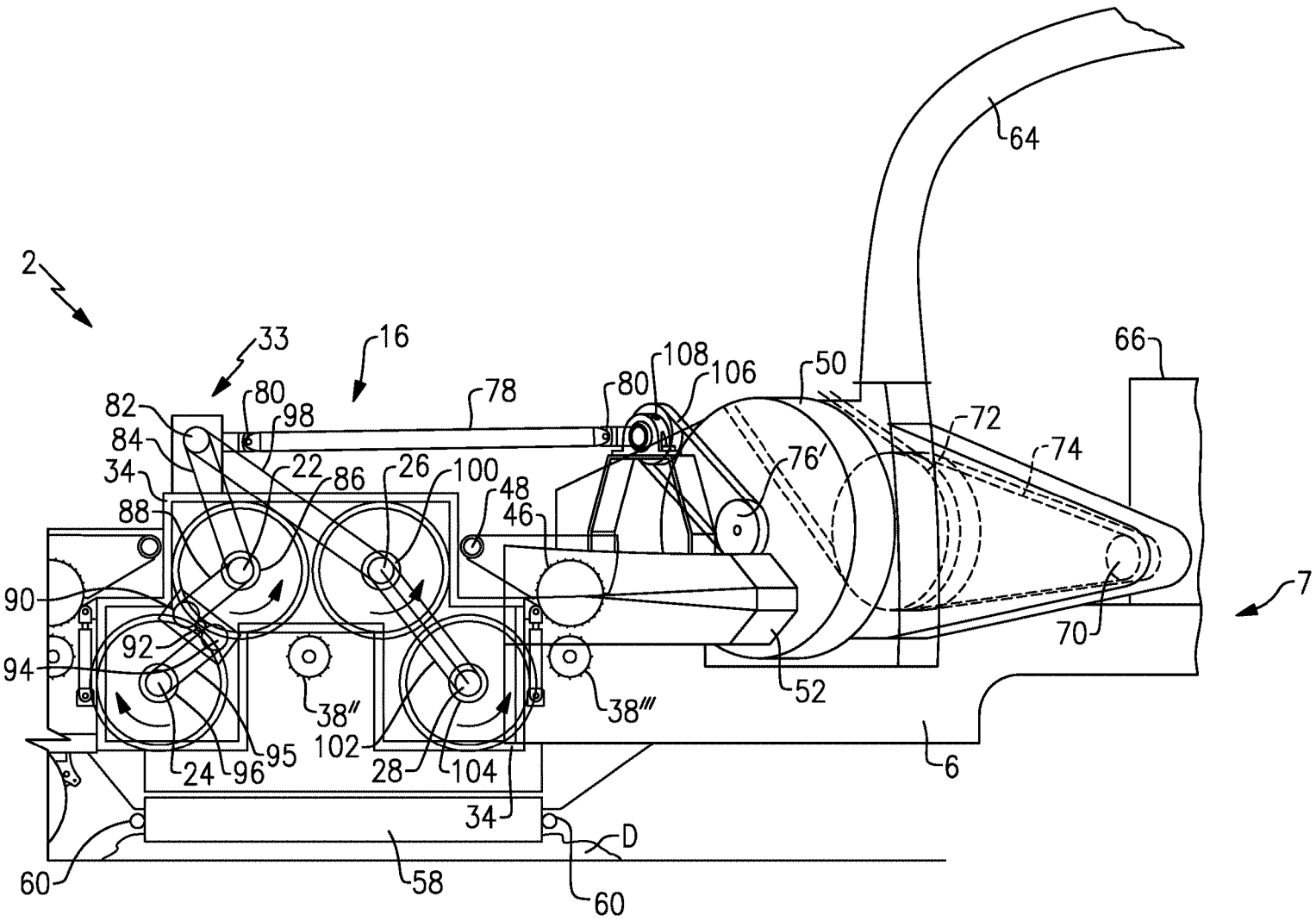
FIG. 3 is a diagrammatic side elevation view of an embodiment of a chain flail debarking apparatus including a disc shaft through drive and a belt drive for driving the flail assemblies.

FIGS. 1-3 show an embodiment of a chain flail debarking apparatus 2 suitable for removing limbs and bark from a log(s) and/or tree(s) 4', 4" (see FIGS. 1A and 1B) that contains bark on an exterior surface thereof.

As shown in FIGS. 1-2, the chain flail debarking apparatus 2 comprises a base frame 6 which has a first (leading) end 7 and a second (trailing) end 9. A kingpin 8 is attached to an undersurface of the leading end of the base frame 6 (see FIG. 1). The kingpin 8 is designed to engage with a rear section of a tractor (not shown) to facilitate transportation of chain flail debarking apparatus 2. The rear section of the base frame 6 is supported by at least one pair, and more preferably, two or three pairs of wheels 10.

The chain flail debarking apparatus 2 has a flail chamber 16 which, in this embodiment, accommodates a first pair of flail assemblies 12, comprising first and second horizontal rotatable flail shafts 22, 24, and a second pair of flail assemblies 14, comprising third and fourth horizontal rotatable flail shafts 26, 28. The flail chamber 16 has a flail inlet, through which the log(s) and/or tree(s) 4', 4' to be treated enters, and a flail outlet, through which the treated log(s) and/or tree(s) 4', 4' exits (neither the flail inlet nor the flail outlet is shown in detail). Each of the first, the second, the third and the fourth horizontal rotatable flail shafts 22, 24, 26, 28 are operatively connected to be driven by a drive assembly, and a further discussion concerning the drive supplied to each of the horizontal rotatable flail shafts 22, 24, 26, 28 of the first and second flail assemblies 12, 14 will be provided below.

Each one of the horizontal flail shafts 22, 24, 26, 28 supports a plurality of chains 32 (only diagrammatically shown in the drawings) on an exterior surface thereof. A first end of each one of the plurality of chains 32 is connected to one of the horizontal flail shafts 22, 24, 26 and 28. Each of the plurality of chains 32 are secured, at spaced apart locations, along the length of as well as around a circumference of each one of the horizontal flail shafts 22, 24, 26, 28. As each horizontal flail shaft 22, 24, 26, 28 rotates in a desired (clockwise or counter clockwise) rotational direction, the second free ends of each of the supported chains 32 are flung radially outward, via centrifugal force, from the respective flail shaft 22, 24, 26, 28 in a substantially radial direction. As the log(s) and/or tree(s) 4', 4" pass through the flail chamber 16, free ends of the rotating chains 32 engage, hit, pound and/or abrade against the exterior surface of the log(s) and/or tree(s) 4', 4" to cut, dislodge and/or remove any remaining limbs as well as remove as much bark as possible therefrom.

Each opposed end of each one of the flail shafts 22, 24, 26, 28, of the two pairs of flail assemblies 12, 14, is supported by the movable flail assembly framework 34 (only diagrammatically shown in the drawings). In addition, each one of the flail shafts 22, 24, 26, 28 is rotatable relative to the flail assembly framework 34 by a set of bearing (not shown in detail. A flail drive input 33 of the drive assembly, for rotatably driving each one of the flail assemblies 12, 14, is supported by a vertically upper region of the movable flail assembly framework 34 so as move therewith, as discussed below in further detail.

At least one displacement member interconnects the movable flail assembly framework 34 with the base frame 6. The at least one displacement member comprises, for example, four framework hydraulic cylinders 36, only two of which are shown in FIG. 1. A first set of the framework hydraulic cylinders 36 (one connected to the left side and the other connected to the right side of the base frame 6) are connected to the trailing end of the movable flail assembly framework 34 while a second set of the framework hydraulic cylinders 36 (one connected to the left side and the other connected to the right side of the base frame 6) are connected to the leading end of the movable flail assembly framework 34. As result of such connection, during operation, the movable flail assembly framework 34 is vertically movable with respect to the base frame 6 of the chain flail debarking apparatus 2, along vertical guide tracks (not shown in detail), to alter the relative position of the movable flail assembly framework 34 of the flail chamber 16 with respect to a reference plane P of the chain flail debarking apparatus 2 (see FIGS. 1A and 1B), which is defined further below. The purpose of such vertical movement of the movable flail assembly framework 34, within the flail chamber 16, with respect to the reference plane P will become apparent from the following description.

In a normal, vertically lower most, unactuated position of the movable flail assembly framework 34, a vertical spacing of a rotational axis of each one of the two axially adjacent upper (first and third) flail shafts 22, 26 away from the reference plane P is the same as a vertical spacing of a rotational axis of each one of the two axially spaced apart lower (second and fourth) flail shafts 24, 28 away from the reference plane P. Such uniform spacing of each one of the flail shafts 22, 24, 26 and 28, from the reference plane P, provides substantially equal treatment or processing of both the upwardly facing and the downwardly facing surfaces of the log(s) or trunk(s) being debarked in the flail chamber 16, assuming that the central axis of the log(s) or trunk(s) being processed is coincident with the reference plane P.

One or more spiked transfer roller(s) 38, 38', or possibly a conveyor belt or some other conventional transfer mechanism, is/are located within a feed section 40 of the chain flail debarking apparatus 2 to assist with feeding log(s) and/or tree(s) 4', 4", to be debarked, into the flail chamber 16 via the flail inlet. As shown in FIG. 1 for example, first and second spaced apart spiked transfer rollers 38, 38' are provided for feeding the desired log(s) and/or tree(s) 4', 4" into the flail inlet. In addition, a first pivotable spiked feed roller or movable guide 42 is positioned above and overlies the (second) spiked transfer roller 38' located adjacent the flail inlet 118. The first spiked pivotable feed roller 42 is movable/pivotable toward and away from the (second) spiked transfer roller 38', about a hinge 44, as one or more log(s) and/or tree(s) 4', 4" pass between the first spiked pivotable feed roller 42 and the spiked transfer roller 38', and a further discussion concerning the function of the first spiked pivotable feed roller 42 will be provided below.

In addition, one or more spiked transfer roller(s) 38", is/are located within the flail chamber 16 to assist with conveying of the log(s) and/or tree(s) 4', 4" being processed within the flail chamber 16. As shown in FIG. 1, at least one or possibly a pair of spiked transfer rollers 38" is/are located within the flail chamber 16, between the first pair of flail assemblies 12 and the second pair of flail assemblies 14 to support the log(s) or trunk(s) being processed within the flail chamber 16.

After sufficient processing within the flail chamber 16, the debarked log(s) and/or tree(s) 4', 4" eventually exits therefrom, via the flail outlet, and is/are subsequently transferred, via one or more (fourth) spiked transfer roller(s) 38'", or possibly a conveyor belt or some other conventional transfer mechanism, from the flail outlet and to an inlet 52 of a disc chipper 50. To assist with such transfer, a second pivotable spiked feed roller 46 typically is located above and overlying the (fourth) spiked transfer roller 38'" located adjacent the flail outlet. The second spiked pivotable feed roller 46 is movable/pivotable toward and away from the (fourth) spiked transfer roller 38'" adjacent the flail outlet 20, via a pivot 48, as one or more debarked log(s) and/or tree(s) 4', 4" exit from the flail chamber 16 and is/are conveyed, between the second pivotable feed roller 46 and the (fourth) spiked transfer roller 38'", toward the inlet 52 of the disc chipper 50.

Each one of the spiked transfer roller(s) 38, 38', 38", 38'" is typically driven at the same speed and in a same rotational direction by a (hydraulic) drive (not shown in detail) in order to facilitate conveying the log(s) and/or tree(s) 4', 4" from the feed section 40, into and through the flail chamber 16, and from the flail outlet into the inlet 52 of the disc chipper 50. It is to be appreciated that the top surface of each one of the spiked transfer roller(s) 38, 38', 38", 38'" all generally lie within and are coincident with a (horizontal) plane P which extends horizontally through the chain flail debarking apparatus 2 to facilitate conveyance of the log(s) and/or tree(s) 4', 4" though the chain flail debarking apparatus 2. This horizontal plane P defines the reference plane P of the chain flail debarking apparatus 2.

The flail chamber 16 is typically closed to the exterior environment on the top and along both the left and right sides thereof while a bottom portion of the flail chamber 16 is generally open (not shown in detail) so as to permit the removed/dislodged bark, limbs, leaves, branches and/or other debris D to fall through the open bottom, due to gravity, and collect in a debris collection area 56 located directly below the opening in the flail chamber 16. A hydraulically operated plunger 58 is supported by the base frame 6, below the opening formed in the bottom portion of the flail chamber 16 but above the ground which generally forms the debris collection area 56. The plunger 58 is normally located in a retracted position adjacent the left (or possibly the right) sidewall of the chain flail debarking apparatus 2. A pair of horizontal plunger hydraulic cylinders 60 interconnect the plunger 58 with the base frame 6. That is, a first end of each respective cylinder is connected to the base frame 6 while a second end of a first one of the cylinders 60 is connected to a first end of the plunger 58 and a second end of the other cylinder 60 is connected to a second end of the plunger 58. The plunger 58 and the cylinders 60 together form an extendible and retractable plunger assembly for clearing debris D.

Once a sufficient amount of removed/dislodged bark, limbs, leaves, branches and/or other debris D falls and collects in the debris collection area 56, during operation of the chain flail debarking apparatus 2, both of the plunger hydraulic cylinders 60 can be simultaneously supplied with hydraulic fluid to alter their length and move (cycle) the plunger 58 into an extended position in order to push and/or force the removed/collected bark, limbs, leaves, branches and/or other debris D away from the debris collection area 56 to a discharge area located along the right (or possibly the left) side of the chain flail debarking apparatus 2. Thereafter, the plunger 58 can be automatically retracted, by the plunger hydraulic cylinders 60, back into its normally retracted position for a further cycle once a sufficient amount of additional dislodged bark, limbs, leaves, branches and/or other debris D again collect within the debris collection area 56. This pushing process, which clears the debris which collects within the collection area 56 by cycling the plunger 58, is repeated numerous times during operation of the chain flail debarking apparatus 2, e.g., once every 5-10 seconds to a few minutes or so, in order to facilitate substantially continuous operation of the chain flail debarking apparatus 2 without an excessive build-up of bark, limbs, leaves, branches and/or debris D in the debris collection area 56. The bark, limbs, leaves, branches and/or other debris D contained within the discharge area can then be periodically removed, in a conventional manner, and property disposed of.

As shown in FIGS. 1, 2 and 3, the disc chipper 50 is supported adjacent the front leading end 7 of the debarking chain flail apparatus 2 and is equipped with a (rotatable) discharge chute 64. The (conventional) internal rotating chipping disc (not shown in detail) of the disc chipper 50 is typically arranged at a 38 degree angle with respect to a longitudinal axis A of the chain flail debarking apparatus 2

(see FIG. 1), i.e., a rotational plane defined by the internal rotating chipping disc forms a 38 degree angle with the longitudinal axis A of the chain flail debarking apparatus 2. Such arrangement of the internal rotating chipping disc of the disc chipper 50, with respect to the longitudinal axis A of the chain flail debarking apparatus 2, assists with chipping of the debarked log(s) and/or tree(s) 4', 4" into wood chips having the desired shape and size.

The discharge chute 64 is typically pivotally supported on the disc chipper 50 and the discharge chute 64 may have a partially disassembled/folded storage position (not shown) and an in-use position, as shown in FIG. 1 for example. The discharge chute 64 has a chute inlet located at a first end and a chute outlet located at the opposite second discharge end thereof. The discharge chute 64 can be rotated into a plurality of different discharge orientations which facilitate discharging the generated chips toward the front or on either the left side or the right side of the debarking chain flail apparatus 2, for example. That is, the discharge chute 64 typically has at least 180° of rotation with respect to the debarking chain flail apparatus 2. During use, if the plunger 58 is arranged to facilitate discharging the removed bark, limbs, leaves, branches and/or other debris D on one side of the debarking chain flail apparatus 2, e.g., the right side, then the discharge chute 64 will typically discharge the generated chips on the other side of the debarking chain flail apparatus 2, e.g., the left side, or vice versa, so as to avoid commingling of the debris D with the wood chips.

The plunger assembly may be electrically connected with a control panel (not shown), which incorporates a conventional processor which periodically operates to automatically remove bark, limbs, branches and/or other debris D, which collect within the debris collection area 56. The control panel will periodically cycle the plunger 58, e.g., between 5 seconds and a few minutes or so, in order to remove a sufficient amount of the bark, limbs, branches, leaves and/or other debris D which accumulates in the debris collection area 56.

With reference now to FIG. 2, an embodiment of the drive assembly, for driving both the disc chipper 50 and the first and second flail assemblies 12, 14, via a single motor or engine 66, will now be described. As shown, the single motor or engine 66 is supported adjacent the first (leading) end 7 of the debarking chain flail apparatus 2. The single motor or engine 66 may be, for example, a 1,200±800 horsepower drive which is coupled to a drive input of the disc chipper 50 by a belt drive 68. As shown more clearly in FIGS. 3 and 6, a relatively small sheave 70 is support by the output of the single motor or engine 66 while a relatively larger sheave 72 is supported by the rotatable shaft supporting the internal chipping disc of the disc chipper 50. A V-belt 74 couples the two sheaves 70, 72 with one another so as to reduce the rotational speed supplied, by the single motor or engine 66, to the internal rotating disc of the disc chipper 50. By this arrangement, the engine 66 drives the disc chipper 50 at a desired rotational speed, e.g., typically between 400 and 600 RPM, to generate chips from the log(s) or tree(s) supplied to the inlet 52 thereof.

The rotatable shaft, supporting the internal chipping disc of the disc chipper 50, also forms a drive output from the disc chipper 50 for driving the first and second flail assemblies 12, 14 of the flail chamber 16. A drive shaft 78 couples the shaft output coupling 76 of the disc chipper 50 to the flail drive input 33 for the flail assemblies 12, 14. Preferably two or more universal joints 80, or other conventional coupling members, facilitate connecting the drive shaft 78 to the output coupling 76, of the disc chipper 50, with the flail drive input 33 for the flail assemblies 12, 14. The at least two or more universal joints 80 and the at least one drive shaft 78 facilitate converting the drive output from the disc chipper 50, which is arranged at 38 degrees, e.g., ±5 degrees, with respect to the longitudinal axis A of the chain flail debarking apparatus 2, to the flail drive input 33 for the flail assemblies 12, 14.

The flail drive input 33 for the flail assemblies 12, 14 comprises a 90 degree drive which has a drive input which is connected with the drive assembly and has a common output double sheave 82 as the drive output therefrom. A first drive belt 84 couples the common output double sheave 82 with a double first sheave 86, supported adjacent one end of the rotatable first flail shaft 22, so as to drive that first flail shaft 22 in a counter clockwise rotation direction. A second drive belt 88 couples the double first sheave 86 with a first intermediate sheave 90 and the first intermediate sheave 90 is, in turn, directly coupled for driving an intermediate gear 92. The intermediate gear 92, in turn, is directly coupled for driving a second intermediate sheave 94. The second intermediate sheave 94 drives, via belt 95, a second sheave 96, supported adjacent one end of the rotatable second flail shaft 24, so as to drive that second flail shaft 24 in a clockwise rotational direction.

A third drive belt 98 couples the common output double sheave 82 with a double third sheave 100, supported adjacent one end of the rotatable third flail shaft 26, so as to drive the third flail shaft 26 also in a counter clockwise rotation direction. A fourth drive belt 102 couples the double third sheave 100 with a fourth sheave 104, supported adjacent one end of the rotatable fourth flail shaft 28, so as to drive that fourth flail shaft 28 in a clockwise rotational direction. It is to be appreciated that the common output double sheave 82, the rotatable first, the second, the third and the forth flail shafts 22, 24, 26, 28, the first and the second intermediate sheaves 90, 94 and the intermediate gear 92 are all supported by the movable flail assembly framework 34 so as to move vertically up and down therewith.

The first pivotable spiked guide or feed roller 42 is coupled to a device (not shown in detail) which controls the quantity of hydraulic fluid which is permitted to flow to the hydraulic cylinders 36 (see FIGS. 1-2) and thereby control the position of the movable flail assembly framework 34 relative to the base frame 6 of the chain flail debarking apparatus 2. During initial operation of the chain flail debarking apparatus 2, the movable flail assembly framework 34 is located in its lower most position, shown in FIG. 1, with the first pivotable spiked feed roller 42 located closely adjacent, but spaced slightly vertically above the spiked transfer roller 38' located adjacent the flail inlet of the flail chamber 16. In this position, substantially no hydraulic fluid is supplied to any of the hydraulic cylinders 36 and the movable flail assembly framework 34 remains in its lower most vertical position such that the reference plane P passes horizontally between the upper first and third flail shafts 22, 26 and lower second and fourth flail shafts 24, 28 and the upper first and third flail shafts 22, 26 are spaced from the reference plane P substantially the same distance that the lower second and fourth flail shafts 24, 28 are spaced from the reference plane P.

In the event that a smaller diameter log 4', for example, is fed along the feed section 40 of chain flail debarking apparatus 2 and engages with first pivotable spiked feed roller 42 (see FIG. 1A) and the spiked transfer roller 38' located adjacent the flail inlet, the first pivotable spiked feed roller 42 pivots away from the spiked transfer roller 38', due to such engagement, so as to permit the smaller diameter log 4' to pass therebetween. Such pivoting motion of the first pivotable spiked feed roller 42, in turn, initiates a relatively small flow of hydraulic fluid, from the source of hydraulic fluid to the hydraulic cylinders 36, so as to increase the length of the hydraulic cylinders 36 and thereby move the movable flail assembly framework 34 a corresponding distance away from its lower most vertical position and thereby maintain the smaller diameter log 4' substantially centered with respect to the first and second pairs of rotating flail assemblies 12, 14.

Assuming that the smaller diameter log 4' has a diameter of 10 inches, for example, then movement of the first pivotable spiked feed roller 42 vertically upward by a distance of about 10 inches causes a sufficient amount of hydraulic fluid to be supplied to the hydraulic cylinders 36 so as to move the entire movable flail assembly framework 34 a distance of 5 inches (i.e., % of the diameter of the smaller diameter log) vertically away from its lower most vertical position. As a result of such movement of the movable flail assembly framework 34, both the upwardly facing and the downwardly facing surfaces of the smaller diameter log 4' will be substantially equally treated and processed by the chains 32 of the first and second flail shafts 22, 24 of the first flail assembly 12 and also by the chains 32 of the third and fourth flail shafts 26, 28 of the second flail assembly 14 as the smaller diameter log 4' passes through the flail chamber 16. The position of the rotatable flail chamber spiked transfer roller 38", located within the flail chamber 16 remains stationary and does not move with the movable flail assembly framework 34 but assists with maintaining the bottom surface of the smaller diameter log 4' coincident with the reference plane P so that the smaller diameter log 4' remains centered with respect to the upper first and third flail shafts 22, 26 and the lower second and fourth flail shafts 24, 28.

On the other hand, if a larger diameter log 4", for example, is fed along the feed section 40 of the chain flail debarking apparatus 2 and engages with the first pivotable spiked feed roller 42 (see FIG. 1B) and the spiked transfer roller 38' located adjacent the inlet to the flail chamber 16, due to such engagement, the first pivotable spiked feed roller 42 pivots away from the spiked transfer roller 38' a greater distance so as to permit the larger diameter log 4" to pass therebetween. Such greater pivoting motion of the first pivotable spiked feed roller 42 causes, in turn, a greater amount of hydraulic fluid to be supplied from the source of hydraulic fluid to the hydraulic cylinders 36 so as to increase the length of the hydraulic cylinders 36 by a greater distance and thus move the movable flail assembly framework 34 a corresponding greater distance away from its lower most vertical position and thereby still maintain the larger diameter log 4" substantially centered with respect to the upper first and third flail shafts 22, 26 and the lower second and fourth flail shafts 24, 28.

Assuming that the larger diameter log 4" has a diameter of 22 inches, for example, then movement of the first pivotable spiked feed roller 42 vertically upward by a distance of about 22 inches causes a sufficient amount of hydraulic fluid to be supplied to the hydraulic cylinders 36 so as to move the entire movable flail assembly framework 34 by a distance of 11 inches (i.e., % of the diameter of the larger diameter log 4") vertically away from its lower most vertical position. As a result of such movement of the movable flail assembly framework 34, both the upwardly facing and the downwardly facing surfaces of the larger diameter log 4" will still be substantially equally treated by the chains 32 of the first and second flail shafts 22, 24 of the first flail assembly 12 and also by the chains 32 of the third and fourth flail shafts 26, 28 of the second flail assembly 12 as the larger diameter log 4" passes through the flail chamber 16. The position of the rotatable flail chamber spiked transfer roller 38" remains stationary but assists with maintaining the larger diameter log 4" centered with respect to the upper first and third flail shafts 22, 26 and lower second and fourth flail shafts 24, 28.

The hydraulic cylinders 36 typically have a vertical stroke about 15 to 16 inches in order to move the entire movable flail assembly framework 34 vertically by a distance of 15 to 16 inches away from its lower most vertical position to its highest most vertical position. Accordingly, the chain flail debarking apparatus 2 is typically able to process logs having a diameter of up to about 28-30 inches or so. It will be understood that longer or shorter cylinders may be utilized, depending on the types of logs/slabs/trees being processed, to accommodate different size log(s) or tree(s).

Turning now to FIG. 3, another embodiment of the drive assembly will now be described. As this embodiment is very similar to the previously discussed embodiment, only the differences between this new embodiment and the previous embodiment will be discussed in detail while identical elements will be given identical reference numerals.

As with the previous embodiment, a single motor or engine 66 is supported adjacent the first (leading) end 7 of the debarking chain flail apparatus 2. The single motor or engine 66 drives, via a belt drive 74, the shaft supporting the internal rotating disc of the disc chipper 50 at a desired rotational speed.

As with the previous embodiment, the shaft supporting the internal rotating disc of the disc chipper 50 also forms a drive output from the disc chipper 50 for driving the first and second flail assemblies 12, 14 of the flail chamber 16. According to this embodiment, the drive output coupling is a disc sheave 76' which is secured to the rotatable shaft supporting the internal chipping disc of the disc chipper 50. A conventional belt 106 couples the disc sheave 76' of the internal rotating disc with a mating drive sheave 108. The mating drive sheave 108 is supported at one end of the drive assembly for supplying rotational drive thereto. The drive assembly further comprises at least one drive shaft 78 and typically at least two or more universal joints 80. The at least two or more universal joints 80 and the at least one drive shaft 78 facilitate transferring the drive output from the disc chipper 50, which is arranged at 38 degrees with respect to the longitudinal axis A of the chain flail debarking apparatus 2, to the flail drive input 33 for driving the flail assemblies 12, 14.

It is also possible that a gearbox (not shown in detail), forming the drive output coupling 76, may be connected to rotatable shaft of the rotating disc, for supplying drive to the flail assemblies 12, 14. The gearbox is designed to compensate for the 38 degree angle of input drive from the disc chipper 50 and provide an input drive to the flail drive input 33 of the flail assemblies 12, 14. As with the previous embodiment, the drive assembly, which couples the gearbox to the flail drive input 33, would still typically comprise at least one drive shaft 78 and at least two universal joints 80 which facilitate transferring drive therebetween. Due to such arrangement, the gearbox/drive assembly would supply uninterrupted drive to the flail chamber 16, as the movable flail assembly framework 34 moves up and down during operation of the debarking chain flail apparatus 2.

According to this embodiment, the flail drive input 33 for the flail assemblies 12, 14 comprises a 90 degree drive which has a drive input which is connected with the drive assembly and has a common output double sheave 82 as the drive output therefrom. The first drive belt 4 couples the common output double sheave 82 with the double first sheave 86, supported adjacent one end of the first rotatable flail shaft 22, so as to drive that first flail shaft 22 in a counter clockwise rotation direction. The second drive belt 88 couples the double first sheave 86 with the first intermediate sheave 90 and the first intermediate sheave 90 is, in turn, directly coupled a reversing gearbox 92 which reverse the rotational drive. The reversing gearbox 92, in turn, is directly coupled for driving the second intermediate sheave 94. The second intermediate sheave 94 drives, via belt 95, the second sheave 96 supported adjacent one end of the second rotatable flail shaft 24 so as to drive that second flail shaft 24 in a clockwise rotational direction.

The third drive belt 98 couples the common output double sheave 82 with the double third sheave 100 supported adjacent one end of the rotatable third flail shaft 26 so as to drive the third flail shaft 26 also in a counter clockwise rotation direction. The fourth drive belt 102 couples the double third sheave 100 with the fourth sheave 104 supported adjacent one end of the rotatable fourth flail shaft 28 so as to drive the rotatable fourth flail shaft 28 in a clockwise rotational direction. It is to be appreciated that the common output double sheave 82, the rotatable first, second, third and fourth flail shafts 22, 24, 26, 28, the first and the second intermediate sheaves 90, 94 and the intermediate gear 92 are all supported by the movable flail assembly framework 34 so as to move therewith.

Figure 4:
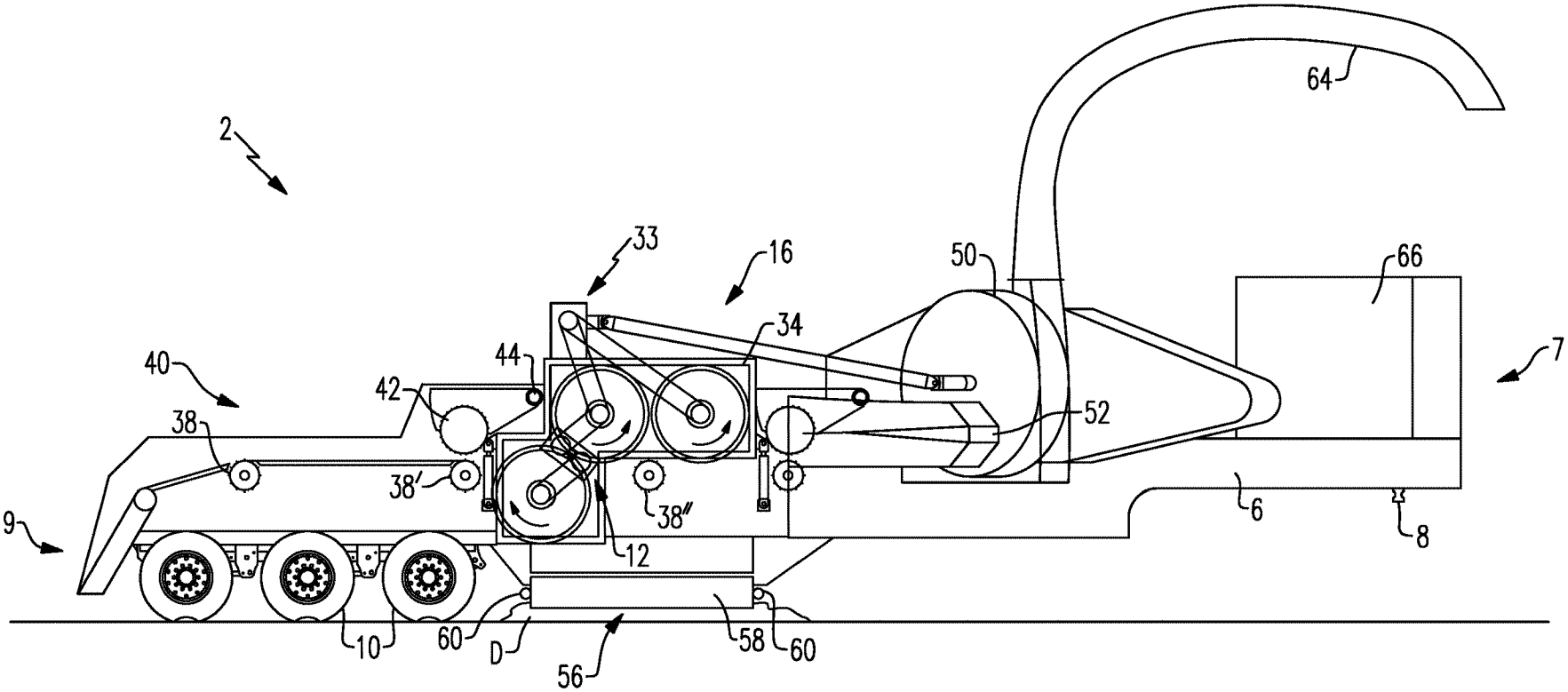
FIG. 4 is a diagrammatic side elevation view of an embodiment of a chain flail debarking apparatus, similar to FIG. 1, including a first pair of flail assemblies and a second trailing flail assembly having only an upper flail section.

Turning now to FIG. 4, another embodiment of the debarking chain flail apparatus 2 will now be described. As this embodiment is very similar to the previously discussed embodiment of FIG. 2, only the differences between this new embodiment and that previously discussed embodiment will be discussed in detail while identical elements will be given identical reference numerals.

The primary difference between this embodiment and the first embodiment is a number of flail shafts which form the flail assemblies 12, 14. According to this embodiment, the chain flail debarking apparatus 2 has first set of flail assemblies 12, which still comprises first and second flail shafts 22, 24 and associated chains 32, but only a third flail shaft 26 and its associated chains 32 which form the second flail assembly 14. That is, the fourth flail shaft is completely eliminated in this embodiment. A flail chamber spiked transfer roller 38" is located between the upper first and the third flail shafts 22, 26 to assist with maintaining the log(s) and/or tree(s) 4', 4" centered with respect to the upper first and third flail shafts 22, 26 and the lower second flail shaft 24. The first, second and the third flail shafts 22, 24, 26 all rotate in the direction previously indicated with respect to the first embodiment.

As a result of this arrangement, when a log(s), slab(s) and/or tree(s) 4', 4" passes through the trailing portion of the flail chamber 16, only the chains 32 of the first and the third flail shafts 22 and 26 engage, hit, pound and/or abrade against the exterior surface of the log(s) and/or tree(s) 4', 4" from above while only the chains 32 of the second flail shaft 24 engage, hit, pound and/or abrade against the exterior surface of the log(s) and/or tree(s) 4', 4" from below. Each one of the first, the second and the third flail shafts 22, 24, 26 are driven at substantially the same rotational speed and in the same rotational direction as indicated in the first embodiment by either the drive assembly of FIG. 2 or the drive assembly of FIG. 3, for example, or some other drive assembly which compensates for the 38 degree arrangement of the disc chipper 50 with respect to the longitudinal axis A of the debarking chain flail apparatus 2.

Figure 5:
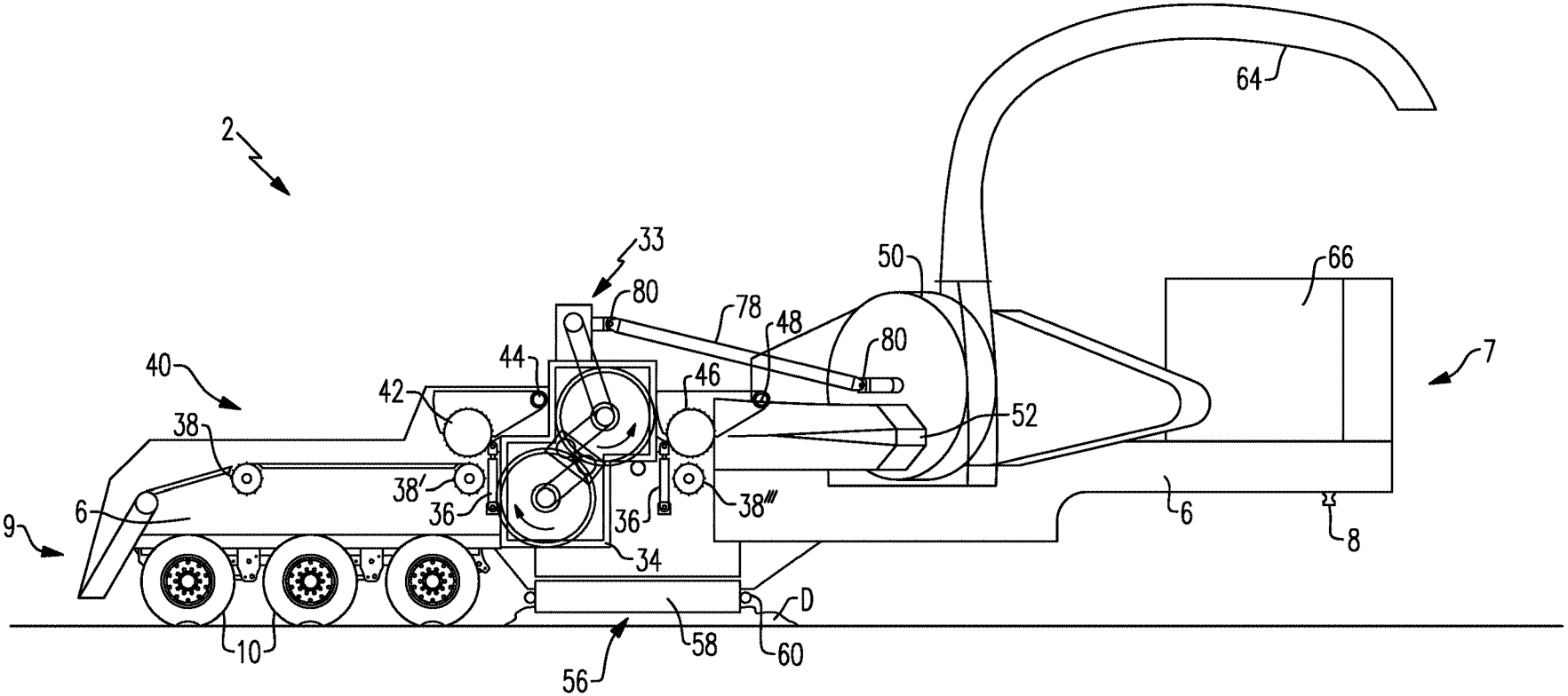
FIG. 5 is a diagrammatic side elevation view of an embodiment of a chain flail debarking apparatus, similar to FIG. 1, including only a first pair of flail assemblies.

Turning now to FIG. 5, still another embodiment of the debarking chain flail apparatus 2 will now be described. As this embodiment is very similar to the previously discussed embodiments, only the differences between this new embodiment and the previous embodiments will be discussed in detail while identical elements will be given identical reference numerals.

The primary difference between this embodiment and the previous embodiments is number of flail assemblies. According to this embodiment, the chain flail debarking apparatus 2 only has the first set of flail assemblies 12, which comprises the first and the second flail shafts 22, 24 as well as their associated chains 32. That is, according to this embodiment, both the third and the fourth flail shafts, as well as their associated chains 32, and the flail chamber spiked transfer 38" are eliminated.

As a result of this arrangement, when a log(s) and/or tree(s) 4', 4" passes through the flail chamber 16, only the chains 32 of the first and the second flail shafts 22, 24 engage, hit, pound and/or abrade against the exterior surface of the log(s) and/or tree(s) 4', 4" from above and below, respectively. Both the first and the second flail shafts 22, 24 are driven at substantially the same rotational speed and in the same rotational direction as indicated in the first embodiment by either the drive assembly of FIG. 2 or the drive assembly of FIG. 3, for example, or some other drive assembly which compensates for the 38 degree arrangement of the disc chipper 50 with respect to the longitudinal axis of the debarking chain flail apparatus 2.

Figure 6:
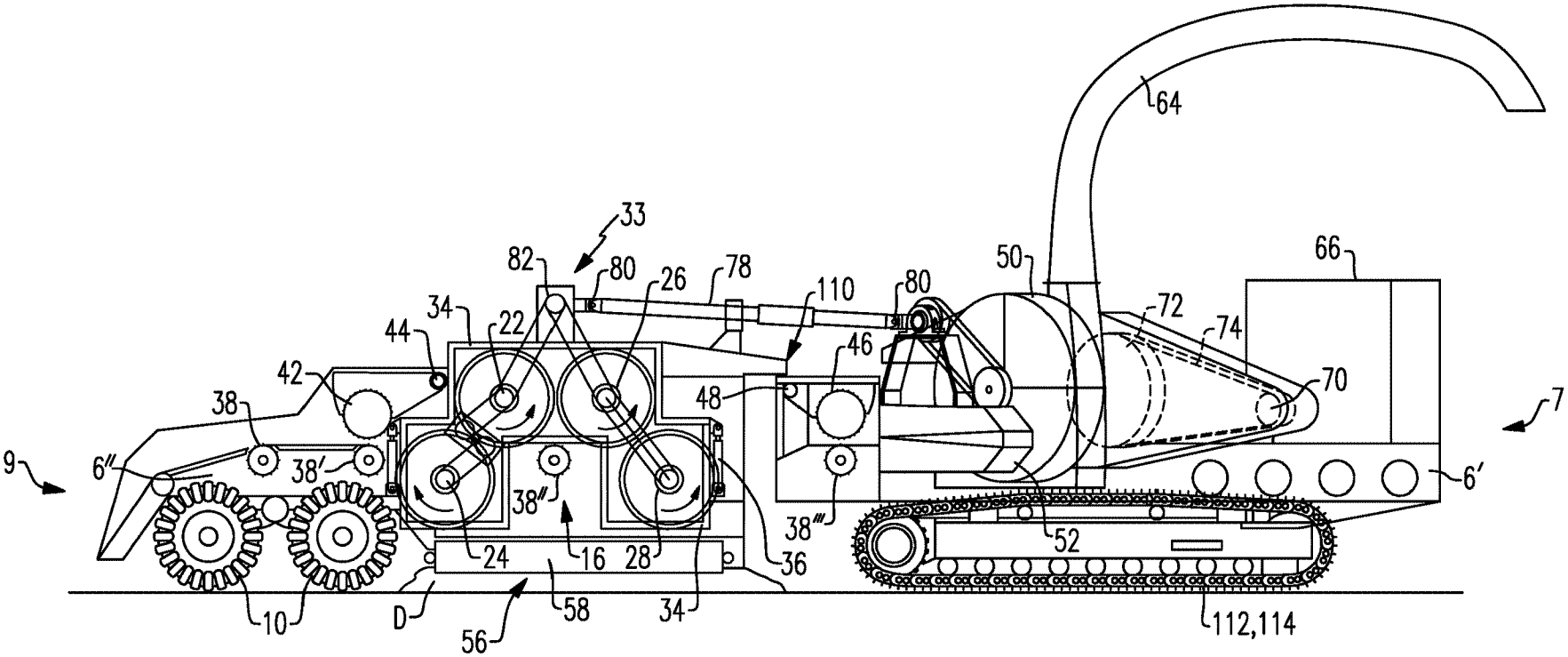
FIG. 6 is a diagrammatic side elevation view of an embodiment of a chain flail debarking apparatus, similar to FIG. 1, having a centrally located input and a track driven disc chipper section to facilitate maneuvering of the chain flail debarking apparatus.

Turning now to FIG. 6, yet another embodiment of the debarking chain flail apparatus 2 will now be described. As this embodiment is very similar to the previously discussed embodiments, only the differences between this new embodiment and the previous embodiments will be discussed in detail while identical elements will be given identical reference numerals.

A primary difference between this embodiment and the previous embodiments is that the base frame 6 is divided into two separate sections, namely, a leading base frame 6' and a trailing base frame 6". The trailing base frame 6" is pivotably or hingedly connected to the leading base frame 6' by a one or more mating hinges or trailer coupling members 110 which permit relative pivoting or turning movement of the leading base frame 6' with respect to the trailing base frame 6".

In addition, the leading base frame 6' is supported by an independent drive unit, e.g., at least first and second sets of drivable wheels or first and second spaced apart and independently drivable tracks 112, 114. In the case of independently drivable tracks, each one of the first and second tracks 112, 114 is supported by a set of sprockets, or some other rotatable components, which facilitate rotation of the respective track relative to the leading base frame 6'. At least one of the sprockets, of each of the first and second tracks 112, 114, is coupled to the source of hydraulic pressure to facilitate supplying hydraulic pressure thereto and rotationally driving that respective sprocket and the associated track 112, 114 in a desired rotational direction. As a result of this arrangement, each of the first and second tracks 112, 114 can be independently driven in either a forward or a reverse driving direction as well as driven at a variety of different rotational speeds. In the case of the first and second sets of drivable wheels, at least one of the wheels, of each set of wheels, is coupled to the source of hydraulic pressure to facilitate supplying hydraulic pressure thereto and rotationally driving that respective wheel(s) in a desired rotational direction and at a desired rotational speed.

Each one of the first, the second, the third and the fourth flail shafts 22, 24, 26, 28, as well as their associated chains 32, can be driven at substantially the same rotational speed and in the same rotational direction, as indicated in the first embodiment by the drive assembly of FIG. 3, for example, or possibly the drive assembly of FIG. 2 or some other drive assembly, which compensates for the 38 degree arrangement of the disc chipper 50 with respect to the longitudinal axis of the debarking chain flail apparatus 2.

According to this embodiment, the rear section of the trailing base frame 6" is supported by at least one pair of wheels 10, e.g., two pairs of wheels are shown. The wheels 10, according to this embodiment, may be larger in diameter to provide additional ground clearance for the portable chain flail debarking apparatus 2 during transportation of the portable chain flail debarking apparatus 2 from one job site to another job site.

The chain flail debarking apparatus 2 of this embodiment, as well as any of the other embodiments, may possibly be equipped with a remote radio controller (not shown in detail) which communicates wirelessly with a control panel (not shown in detail) affixed to the base frame 6 of the portable chain flail debarking apparatus 2. The control panel controls operation of the engine 66, a hydraulic pump and the supply of the hydraulic pressure to the first and the second endless tracks 112, 114 in order to control forward and reverse travel, turning and/or repositioning of the portable chain flail debarking apparatus 2, as required or desired by the operator. As operation of tracked vehicles is conventional and well known in the art, a further detailed description concerning the same is not provided. Typically, the radio controller is configured to be small enough to be held in the hand of the operator so that the communicated inputted commands, from the operator, are transmitted wirelessly by the radio controller to the control panel which, in turn, implements the inputted commands to control remote operation of the portable chain flail debarking apparatus 2.

Figure 7:
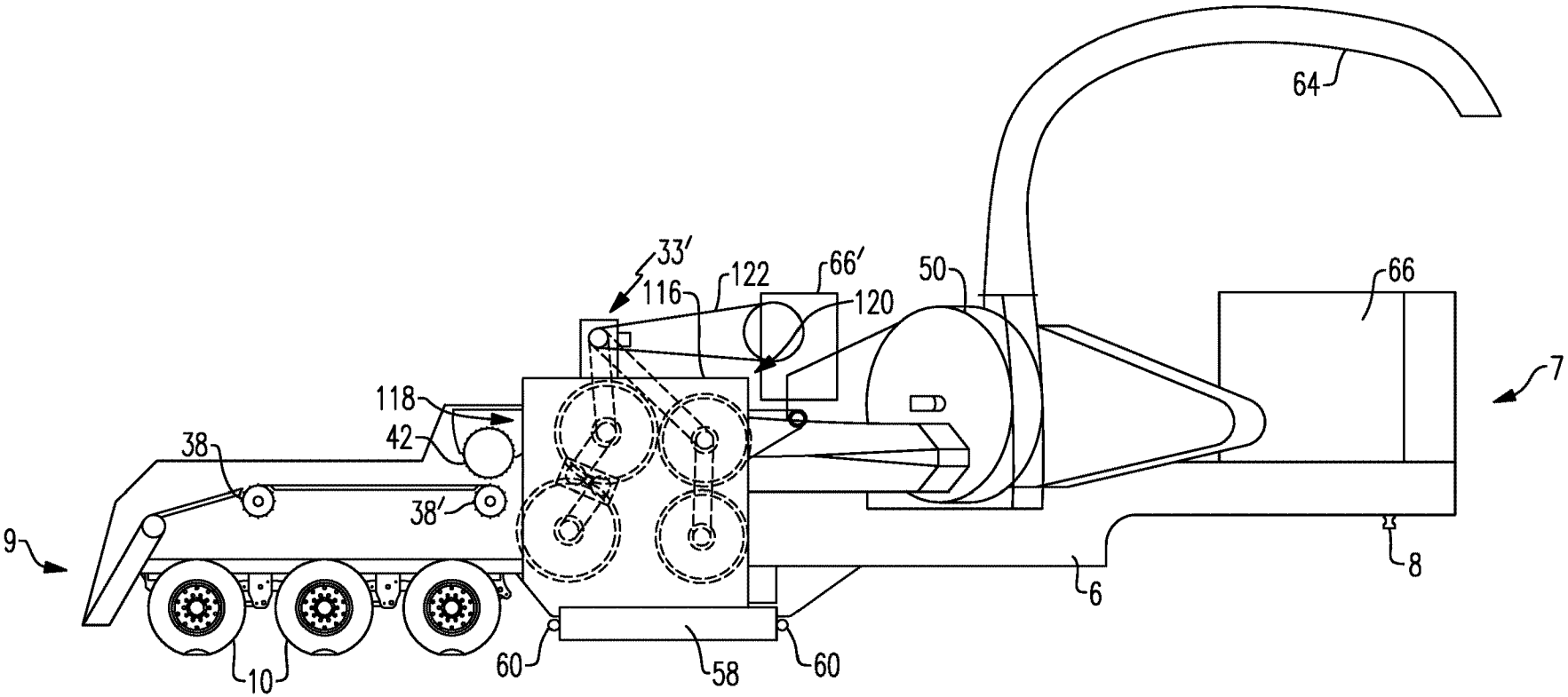
FIG. 7 is a diagrammatic side elevational view, similar to FIG. 5, showing a first drive for driving the disc chipper and a second drive for driving the first and second flail assemblies.

Turning now to FIG. 7, yet another embodiment of the debarking chain flail apparatus 2 will now be described. As this embodiment is very similar to the previously discussed embodiments, only the differences between this new embodiment and the previous embodiments will be discussed in detail while identical elements will be given identical reference numerals.

A primary difference between this embodiment and previously discussed embodiments is that the drive comprises separate first and second drives 66, 66'. That is, the first drive 66 drives the disc chipper in the manner previously discussed while the second drive 66' drives the flail shafts 22, 24, 26, 28 of the flail assemblies 12, 14. The second drive 66' is supported by base frame 6, or possibly the trailing base frame 6'. The two separate drives 66, 66' avoid the need to compensate for the 38 degree angle of the drive output from the rotating chipping disc with respect to the longitudinal axis A of the chain flail debarking apparatus 2. As such, the second drive 66' merely supplies rotational drive, via a V-belt 122, for example, which drives a conventional jackshaft 33' which, in turn, then conveys the rotational drive to the flail assemblies 12, 14 as discussed above.

As shown in FIG. 7, the flail chamber 16 generally comprises an enclosed housing 116 which has the flail inlet 118, at one end of the housing, and the flail outlet 120, at an opposite end of the housing 116. The top and both opposed sidewalls of the housing 116 are substantially closed solid walls which typically (with one exception) do not have any opening(s) formed therein while the bottom of the flail chamber 16 is generally open to permit the removed limbs, branches, leaves, debris, etc., from the log(s) or tree being processed, to fall toward the ground and collect in the debris collection area 56. As indicated above, the top wall of the housing 116 typically has an opening therein for the jackshaft 33' to project therethrough and be coupled to the V-belt 122. The jackshaft 33' is supported by the flail assembly framework 34 while the enclosed housing 116 is typically directly supported by the base frame 6 or the trailing base frame 6".

While the first, the second, the third and the forth flail shafts 22, 24, 26, 28 are described a rotating in a specific rotational direction, it is to be appreciated that the rotational directions of one or more of the first, the second, the third and the forth flail shafts 22, 24, 26, 28 can be easily and readily be modified, without departing form the spirit and scope of the present disclosure. In addition, it is possible that one or more of the first, the second, the third and the forth flail shafts 22, 24, 26, 28 may be geared so as to be driven at different rotational speeds.

In the preceding description, for purposes of explanation, numerous details are set forth in order to provide a thorough understanding of the embodiments. However, it will be apparent to one skilled in the art that these specific details may not be required. In other instances, well-known structures may be shown in simplified or block diagram form in order not to obscure the understanding.

While various embodiments have been described in detail, it is apparent that various modifications and alterations of those embodiments will occur to and be readily apparent to those skilled in the art. However, it is to be expressly understood that such modifications and alterations are within the scope and spirit of the appended claims. In addition, it is to be understood that the phraseology and terminology used herein is for the purpose of description and should not be regarded as limiting. The use of "including," "comprising," or "having," and variations thereof herein, is meant to encompass the items listed thereafter and equivalents thereof as well as additional items while only the terms "consisting of" and "consisting only of" are to be construed in a limitative sense.

I claim:

1. A chain flail debarking apparatus for removing limbs and bark from a log or a tree to be treated, the chain flail debarking apparatus comprising:

a base frame supporting a flail chamber and at least one transfer roller to facilitate feeding of the log or tree into the flail chamber;

a flail assembly framework being supported by the base frame within the flail chamber, and the flail assembly framework being vertically movable relative to the base frame by at least one displacement member;

at least a first flail assembly comprising first and second rotatable flail shafts, the first and the second rotatable flail shafts being supported by the flail assembly framework so as to move along with the flail assembly framework, and each of the first and second rotatable flail shafts supporting a plurality of chains;

a movable guide being located adjacent an inlet of the flail chamber for determining a diameter of the log or tree entering into the flail chamber and activating the at least one displacement member so as to adjust a position of the flail assembly framework, relative to the base frame, and maintain the log or tree, entering into the flail chamber, substantially centered between at least the first and second rotatable flail shafts so that the log or tree, entering into the flail chamber, is substantially uniformly debarked; and the flail chamber supports a second flail assembly, located downstream of the first flail assembly, which comprises a third shaft, and the third flail shafts support a plurality of chains.

2. The chain flail debarking apparatus according to claim 1, wherein a disc chipper, for receiving the debarked log or tree, is located adjacent an outlet of the flail chamber, and the disc chipper chips the log or tree, exiting from the chain flail debarking apparatus, into wood chips having a desired size.

3. The chain flail debarking apparatus according to claim 1, wherein a single drive drives a drive assembly which drives both the disc chipper and the flail shafts located within the flail chamber.

4. The chain flail debarking apparatus according to claim 1, wherein the flail chamber supports a second flail assembly, located downstream of the first flail assembly, which comprises third and fourth flail shafts, and each of the third and fourth flail shafts supports a plurality of chains.

5. The chain flail debarking apparatus according to claim 1, wherein the at least one displacement member comprises at least two hydraulic cylinders which interconnect the base frame with the movable flail assembly framework so as to adjust the vertical position of the flail assembly framework, relative to the base frame, during operation of the chain flail debarking apparatus.

6. The chain flail debarking apparatus according to claim 1, wherein a flail drive input is connected to the drive assembly for rotatably driving each one of the flail assemblies, the flail drive input is supported by an upper region of the flail assembly framework so that the flail drive input moves along with the flail assembly framework, and the flail drive input simultaneously drives each one of the flail shafts in a desire rotational direction.

7. The chain flail debarking apparatus according to claim 3, wherein the drive assembly comprises a belt drive which couples the single motor to a shaft of a rotor of the disc chipper, a shaft output coupling is also coupled to the shaft of the rotor, a drive shaft interconnects the shaft output coupling with a flail drive input for supplying rotation drive to each one of the flail shafts.

8. The chain flail debarking apparatus according to claim 3, wherein the drive assembly comprises a belt drive which couples the single motor to a shaft of a rotor of the disc chipper, a shaft output coupling is also coupled to the shaft of the rotor, a further belt drive couples the shaft output coupling to a first end of a drive shaft and the drive shaft is connected to a flail drive input for supplying rotation drive to each one of the flail shafts.

9. The chain flail debarking apparatus according to claim 1, wherein the flail chamber is closed along both sides thereof while a bottom of the flail chamber is open so as to permit removed/dislodged bark and limbs to fall, due to gravity, and collect in a debris collection area located below the open bottom of the flail chamber.

10. The chain flail debarking apparatus according to claim 9, wherein a plunger is supported by the base frame, below the open bottom portion of the flail chamber, adjacent one side of the debris collection area, the plunger is normally located in a retracted position adjacent a sidewall of the chain flail debarking apparatus but is operable into an extended position, by a pair of plunger hydraulic cylinders, once a sufficient amount of debris collects in the debris collection area, to push the debris from the debris collection area into a discharge area and, thereafter, the plunger is returned back to its retracted position for another cycle.

11. The chain flail debarking apparatus according to claim 2, wherein the disc chipper is arranged at approximately a 38±5 degree angle with respect to a longitudinal axis of the chain flail debarking apparatus, and an outlet of the disc chipper is equipped with a discharge chute, and the discharge chute is movable into a plurality of different discharge orientations to facilitate discharging wood chips on either side of the debarking chain flail apparatus.

12. The chain flail debarking apparatus according to claim 1, wherein the base frame is comprises a leading base frame and a trailing base frame, and the trailing base frame is pivotably connected to the leading base frame by at least one coupling member which permits relative pivoting or turning movement between the leading base frame and the trailing base frame.

13. The chain flail debarking apparatus according to claim 12, wherein the leading base frame is supported by a drive unit, and the drive unit facilitates movement of the chain flail debarking apparatus in desired direction of travel.

14. The chain flail debarking apparatus according to claim 13, wherein the drive unit comprises either:

at least first and second sets of drivable wheels; or first and second spaced apart and independently drivable tracks.

15. The chain flail debarking apparatus according to claim 2, wherein a control panel is coupled to a hydraulic pump to control a supply of hydraulic pressure to a drive unit in order to control at least one of forward and reverse travel, turning and repositioning of the chain flail debarking apparatus.

16. The chain flail debarking apparatus according to claim 2, wherein a first drive drives the disc chipper for generating wood chips from each debarked log or tree exiting from the flail chamber, while a second drive drives each one of the flail assemblies located within the flail chamber.

17. The chain flail debarking apparatus according to claim 1, wherein the base frame has a leading end and a trailing end, and a kingpin is attached to an undersurface of the leading end of the base frame to facilitate transportation thereof.

18. A method of forming a chain flail debarking apparatus for removing limbs and bark from a log or a tree to be treated, the method comprising:

supporting, on a base frame, a flail chamber and at least one transfer roller, to facilitate feeding of the log or tree into the flail chamber;

supporting a flail assembly framework on the base frame and within the flail chamber, and positioning at least one displacement member for moving the flail assembly framework relative to the base frame;

forming at least a first flail assembly from first and second rotatable flail shafts, the first and the second rotatable flail shafts being supported by the flail assembly framework so as to move along with the flail assembly framework, and each of the first and second rotatable flail shafts supporting a plurality of chains;

locating a movable guide adjacent an inlet of the flail chamber for determining a diameter of the log or tree entering into the flail chamber and activating the at least one displacement member so as to adjust a position of the flail assembly framework, relative to the base frame, and maintain the log or tree, entering into the flail chamber, substantially centered between at least the first and second rotatable flail shafts so that the log or tree, entering into the flail chamber, is substantially uniformly debarked; and supporting, with the flail chamber, a second flail assembly which is located downstream of the first flail assembly, and which comprises a third shaft, and the third flail shafts support a plurality of chains.

19. A chain flail debarking apparatus for removing limbs and bark from a log or and a tree to be debarked, the chain flail debarking apparatus comprising:

a base frame having a leading end and a trailing end;

at least one pair of wheels supporting the trailing end of the chain flail debarking apparatus;

a flail chamber accommodating at least first and second rotatable flail shafts, both of the first and second rotatable flail shafts having a plurality of chains, and both of the first and second rotatable flail shafts being supported on a movable flail assembly framework so as to move with the movable flail assembly framework; a pick and place apparatus for moving parts; and a disc chipper for receiving the debarked logs and trees from the flail chamber and generating therefrom wood chips having a desired shape and size;

a single drive for driving both the disc chipper and at least the first and second rotatable flail shafts accommodated within the flail chamber; and a pivotable feed roller located adjacent an inlet to the flail chamber for sensing a diameter of the logs and trees to be debarked by the flail chamber and moving the movable flail assembly framework, relative to the base frame, so as to maintain the logs and trees being debarked in the flail chamber, substantially centered with respect to both the first and second rotatable flail shafts so that both upwardly and downwardly facing surfaces of the logs and trees being debarked are substantially equally treated.

* * * * *